US006745911B1

(12) United States Patent
Maestranzi

(10) Patent No.: US 6,745,911 B1
(45) Date of Patent: Jun. 8, 2004

(54) SAFETY RELEASE CABLE FOR A TRAIN

(76) Inventor: Ernest L. Maestranzi, 25013 Crawford Ave., Antioch, IL (US) 60002

( * ) Notice: Subject to any disclaimer, the term of this patent is extended or adjusted under 35 U.S.C. 154(b) by 0 days.

(21) Appl. No.: 10/336,445

(22) Filed: Jan. 3, 2003

(51) Int. Cl.[7] ..... B61G 1/00
(52) U.S. Cl. ..... 213/75 R; 439/34
(58) Field of Search ..... 439/34, 35, 160, 439/157, 483, 352, 144, 142, 153, 310, 372; 213/1.3, 75 R; D13/147, 133

(56) References Cited

U.S. PATENT DOCUMENTS

| | | | | |
|---|---|---|---|---|
| 3,711,816 A | | 1/1973 | Schumacher | |
| 4,784,610 A | | 11/1988 | Stuart | |
| 5,350,312 A | * | 9/1994 | Kuno et al. | 439/310 |
| 5,476,390 A | | 12/1995 | Taguchi et al. | |
| 5,584,712 A | * | 12/1996 | Fukushima | 439/141 |
| 5,611,703 A | | 3/1997 | Okamoto et al. | |
| 5,709,561 A | | 1/1998 | Cadoret et al. | |
| 5,735,702 A | | 4/1998 | Hio | |
| 5,810,612 A | | 9/1998 | Flask et al. | |
| 5,876,225 A | | 3/1999 | Katsuma et al. | |
| 5,964,605 A | * | 10/1999 | Heydorn et al. | 439/159 |
| 6,039,586 A | | 3/2000 | Kitamura | |
| 6,189,714 B1 | | 2/2001 | Kettle, Jr. et al. | |
| 6,296,083 B1 | | 10/2001 | Forbes et al. | |
| 6,361,337 B2 | * | 3/2002 | Kurimoto | 439/157 |
| 6,439,902 B1 | | 8/2002 | Cole et al. | |

FOREIGN PATENT DOCUMENTS

| | | | | |
|---|---|---|---|---|
| EP | 1093193 A1 | * | 4/2001 | H01R/13/635 |

* cited by examiner

*Primary Examiner*—Frantz F. Jules
(74) *Attorney, Agent, or Firm*—Mathew R. P. Perrone, Jr.

(57) ABSTRACT

A safety release cable for a train has a release mechanism mounted on a jumper cable. The release mechanism has an easily gripped handle, which activates the release mechanism substantially along a lineal axis of symmetry for the cable housing, which facilitates attaching and releasing of the cable from the locomotive or transit car.

17 Claims, 5 Drawing Sheets

SAFETY RELEASE CABLE FOR A TRAIN

This invention relates to a safety release cable for a train, and more particularly to a safety release cable for a train adapted to be connected between adjacent locomotives, transit cars and combinations thereof in a train and easily released therefrom.

BACKGROUND OF THE INVENTION

In any industry, safety is extremely important. With the heavy machinery and weight of the vehicles involved, it becomes clear that railroad industry has critical safety problems. It is very critical to be able to connect one railway car to another efficiently and safely. A cable, which insures the efficient connection of one railway car to another, provides a great advantage.

The standard multiple use cable in the railway industry fits into a receptacle on a locomotive or a transit car. What is more important, the receptacle has a notched rim with appropriate pins contained therein to receive the multiple use cable. There is a hinged cover for the receptacle, which serves to close and protect the receptacle, when the receptacle is not in use.

Also for the receptacle, a notch within the rim of the receptacle on the locomotive or transit car guides the positioning of the multiple use cable therein. The multiple use cable has a notched head, with a protruding notch adapted to the received by the notched rim. In this fashion, the head is guided into and engages the receptacle.

Oppositely disposed from the notch on the head is a notched slot. As the cover comes down on the head a notched protrusion in the cover engages in the notched slot, with such engagement both positioning and securing the cable in the receptacle.

The difficulty comes when the head on the cable is removed from the receptacle. The cover must be propped up and the cable head jiggled or moved in order separate that cable from the receptacle. With ice and other cold weather problem that the mix, such cable removal becomes a big problem.

Such cables are used between railway vehicles, which require electrical power. The railway vehicle may be a transit car, a locomotive, or any combination thereof. Transit car is a term commonly used to describe the type of the railroad vehicle adapted to carry and move passengers. Such cables, usually referred to as jumper cables or multiple use cables, provide for transmission of electricity throughout the entire length of a train of transit cars, when required. By connecting two adjacent vehicles together, the required electric power for a train can be transmitted through the jumper cables.

Clearly, an individual railway transit car or locomotive hardly ever remains attached to the same adjacent railway car for an extended period of time. Therefore, the jumper cable, which transfers electrical power from car to car, must be disconnected every time a railway car is placed adjacent to a different railway car. Thus, it is definitely an advantage to be able to efficiently release and reattach the jumper cable.

Every current jumper cable requires a two-handed push and pull operation. Usually, the cable is supported in one hand, while a pulling operation occurs with the other hand. Such an operation is very difficult to keep in a substantially straight line or on an axis. Thus, it is very possible that prongs or other supports of the connection, especially those on the locomotive or railway car, may be damaged. Since such damage is difficult and expensive to repair, it is very desirable to avoid this problem.

For such a cable, it is very critical that it be firmly and quickly attached to a railway car on a train and easily released therefrom. Such requirements do not work together. If the jumper cable is quickly attachable, it is difficult to determine the firmness of the attachment. If the jumper cable is firmly attached, ease of release from the railway car becomes problematical. That structure, which permits a quick attachment, mitigates against a firm attachment definitely, and an ease of release probably.

Absolutely, an additional requirement for any such device is that it be durable. Durability is extremely desirable for the cable itself, and almost mandatory in view of the heavy-duty use such a cable receives in the railroad industry. The heavy weight of the railway cars and train engines or locomotives requires the cable itself to be heavy.

Any release mechanism on a jumper cable for a train must be accessible. Some jumper cables with a release mechanism are difficult to operate, because the positioning of the cable between railway cars impedes access to and ease of operation of the safety release cable. Thus, the release mechanism must also be accessible in close quarters.

These features bring the size and positioning of the release mechanism into great question for the safety release cable for a train. The larger the release mechanism is, the easier it may be to operate. The smaller the release mechanism is, the easier it will fit between a pair of railway cars. Both features are desirable and contradictory. A balance between the two requirements must be found in order to provide an effective safety release cable.

No efficient method of releasing a cable exists. Some of the cable receptacles are awkwardly located. Such a location, combined with the size and weight of the cable makes it hard for any electrician to remove a jumper cable located high on locomotive, even those cables with a device to assist the release. Such an awkward location and the weight of the cable combine to limit the electrician's ability to control the cable at all times, thereby maximizing the chance for injury.

Jumper cables can also be connected in a hard to reach location. For example, some receptacles are positioned either high and away, or low and away between locomotives. Such an awkward position requires to put his body between two locomotives, in order to release the jumper cable. Even so, the electrician for the railroad is many times unable to locate a comfortable position for disconnecting the jumper cable.

Clearly, the jumper cable used to connect two railway vehicles together is exposed to weather conditions. Thus, it is very likely that the jumper cable can be coated with ice. A release mechanism must still operate even in those adverse conditions. Not only that, the worker must be able to operate that release safely. So inappropriate release mechanism will overcome such icing problems. No such mechanism is known in the prior art.

Since the attachment and release of a jumper cable for a train, as used in the railway industry, are so critically important; many efforts to solve these problems are available in the prior art. In spite of all this effort, no device known in the prior art can solve these problems efficiently.

SUMMARY OF THE INVENTION

Among the many objectives of this invention is the provision of a safety release cable for a train with an accessible release handle.

A further objective of this invention is the provision of a safety release cable for a train, which is easily operated.

Yet a further objective of this invention is the provision of a safety release cable for a train, which attaches easily between a pair of railway cars.

A still further objective of this invention is the provision of a safety release cable for a train, which attaches firmly between a pair of railway cars.

Another objective of this invention is the provision of a safety release cable for a train, which releases easily from between a pair of railway cars.

Yet another objective of this invention is the provision of a safety release cable for a train, which is durable.

Still, another objective of this invention is the provision of a safety release cable for a train, with some simplified moving parts.

Also, an objective of this invention is the provision of a safety release cable for a train, which is transportable.

A further objective of this invention is the provision of a safety release cable for a train, which releases axially from between a pair of railway cars.

Yet a further objective of this invention is the provision of a safety release cable for a train, which may be released one-handed.

A still further objective of this invention is the provision of a safety release cable for a train, which minimizes the necessity of a person being between railway cars to attach or release a cable.

Another objective of this invention is the provision of a safety release cable for a train, which minimizes the necessity of a person being between two locomotives to attach or release a cable.

Yet another objective of this invention is the provision of a safety release cable for a train, which is controllable during attachment.

Still, another objective of this invention is the provision of a safety release cable for a train, which is controllable during release.

A further objective of this invention is the provision of a safety release cable for a train, which operates in adverse weather conditions.

A still further objective of this invention is the provision of a safety release cable for a train, which reduces work injuries.

These and other objectives of the invention (which other objectives become clear by consideration of the specification, claims and drawings as a whole) are met by providing a safety release cable for a train, which has a release mechanism mounted on a jumper cable with the release mechanism having an easily gripped handle, which activates the release mechanism substantially along a lineal axis of symmetry for the cable housing, and which, in turn, facilitates the attaching to or the releasing of the jumper cable the locomotive or transit car.

BRIEF DESCRIPTION OF THE DRAWINGS

Throughout the figures of the drawings, where the same part appears in more than one figure of the drawings, the same number is applied thereto.

DESCRIPTION OF THE PREFERRED EMBODIMENTS

With a safety release cable for a train, a connecting cable or a jumper cable has a head assembly on each end thereof in order to complete jumper cable, with release assembly secured to at least one head assembly in order to form the safety release cable. Such a safety release cable provides a connection between adjacent railway cars, adjacent locomotives or another pair of railway vehicles.

The safety release cable of this invention replaces the multiple use cable or jumper cable used to transmit power between two locomotives, a locomotive and a transit car, or two transit cars. By transit car is meant a road vehicle suitable for transporting passengers. Clearly, a passenger train requires a cable between each pair of transit cars as well as between two locomotives, or a locomotive and any transit car.

The head assembly for the safety release cable includes a head cap, a head housing, and a release assembly. The head cap provides for attachment to an individual vehicle. The release assembly provides for removal of the head assembly, and hence the cable, from a railway vehicle.

With the release assembly attached to head assembly, an axial attachment to or removal of the cable from a railroad car can be accomplished in view of the U-shaped gripping member on the handle assembly, which permits a one hand grip. Since the one hand grip activates two, oppositely disposed push rods, head assembly, and thus safety release cable are efficiently removed or attached to the railroad car.

The reason for this efficiency is release assembly of this invention, especially considering that an U-shaped gripping member as a handle design makes easy even for even a short electrician to remove a jumper cable or safety release cable located high on locomotive. The handle assembly allows the electrician to have control of the cable at all times, thereby reducing the chance for injury.

Also, the U-shaped handle may be tapped, with a tool or by hand gently and repeatedly in the event of ice or other interference with release of the cable. Such tapping is easily accomplished with minimal or no damage to the safety release cable and the receptacle. The push rods being operated by the handle in such a uniform fashion greatly facilitate removal of the cable.

It is also very effective for releasing a jumper cable from a hard to reach location. For example, some receptacles are positioned low and away between locomotives. The handle assembly permits a cable to be tapped free from the receptacle without the electrician having to stand or otherwise be positioned between two locomotives. This safety release cable can be used in many different ways, which are both economically and ergonomically friendly, depending on whether locomotive receptacle is located. Furthermore, the electrician is able to locate a comfortable position for disconnecting the safety release cable, because such a position of the handle permits a jumper cable to be kept under control at all times.

Figure 1:
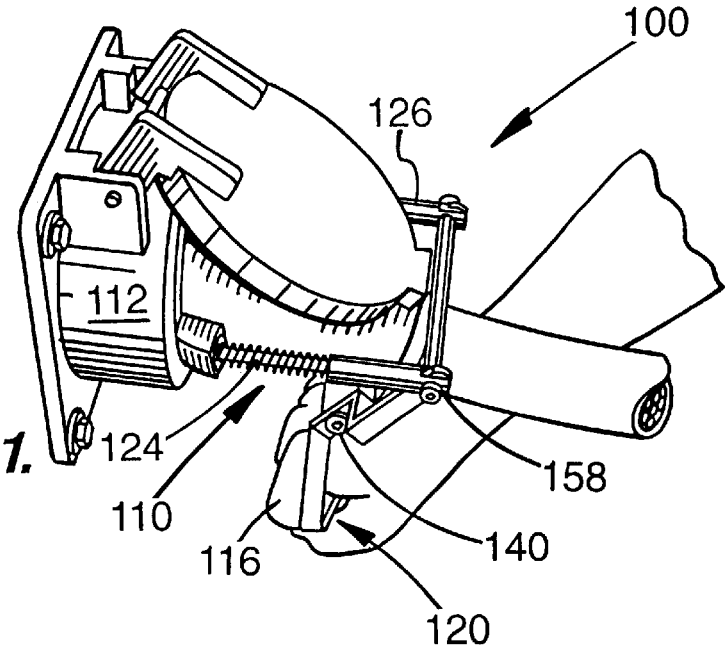
FIG. 1 depicts a perspective view of the safety release cable for a train 100 of this invention in use.

Referring now to FIG. 1, safety release cable assembly 100 has a release assembly 110 secured to head assembly 110. Release assembly 110 includes a hand 116 operating a handle assembly 120 mounted on a hinge 140 and connected to a pin mounting 158. As the handle assembly 120 is activated, pin mounting 158 provides for push rod movement, which can in turn remove safety release cable 100 from the receptacle 112.

Figure 2:
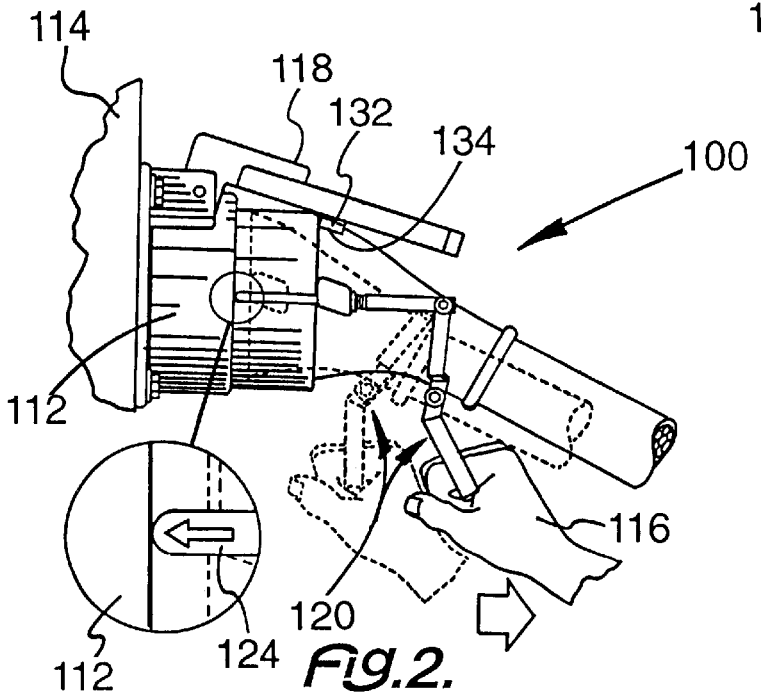
FIG. 2 depicts a side view of safety release cable for a train 100 of this invention based on FIG. 1.
Figure 4:
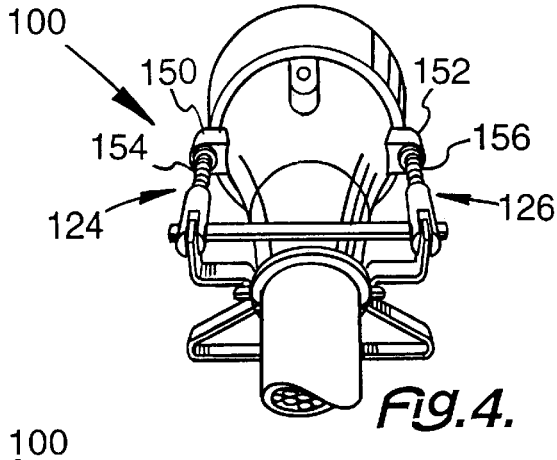
FIG. 4 depicts a top perspective view of safety release cable for a train 100 of this invention.
Figure 5:
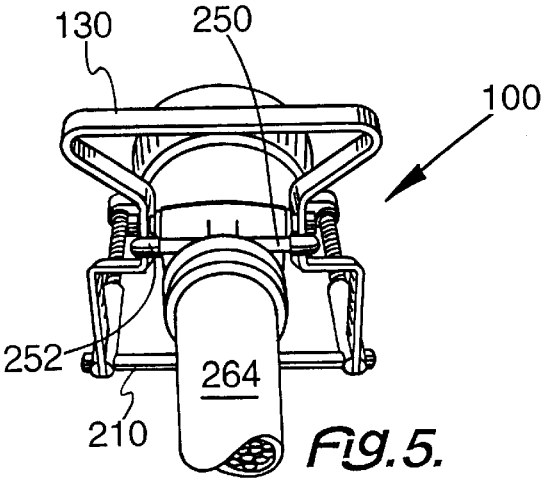
FIG. 5 depicts a top perspective view of safety release cable for a train 100.
Figure 6:
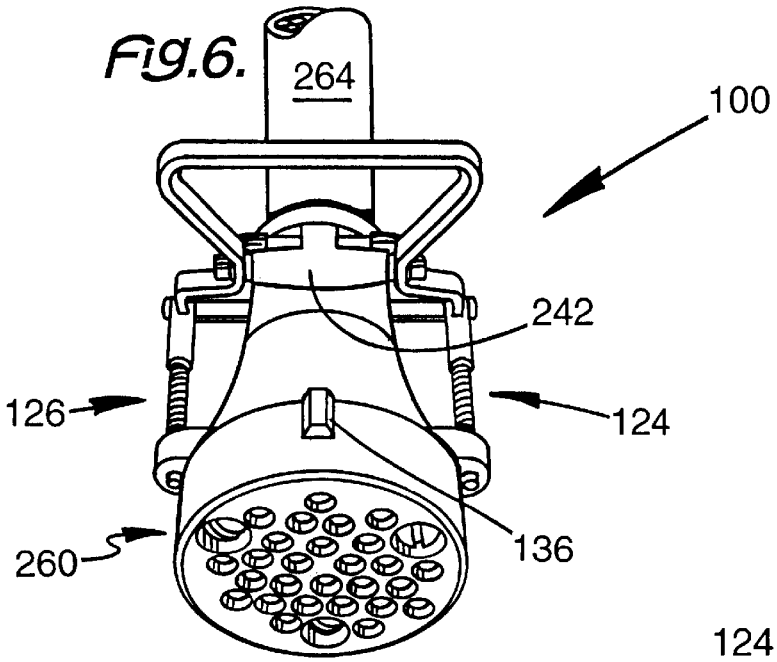
FIG. 6 depicts a bottom perspective view of safety release cable for a train 100.
Figure 7:
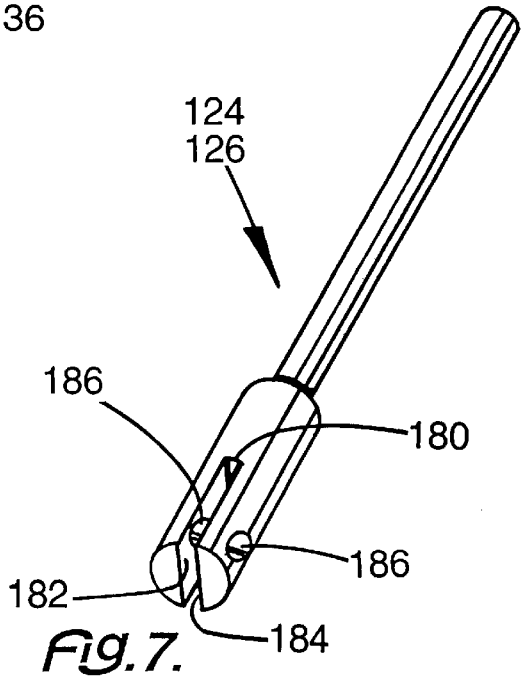
FIG. 7 depicts a perspective view of rod slot 170 suitable for use with a safety release cable for a train 100.
Figure 8:
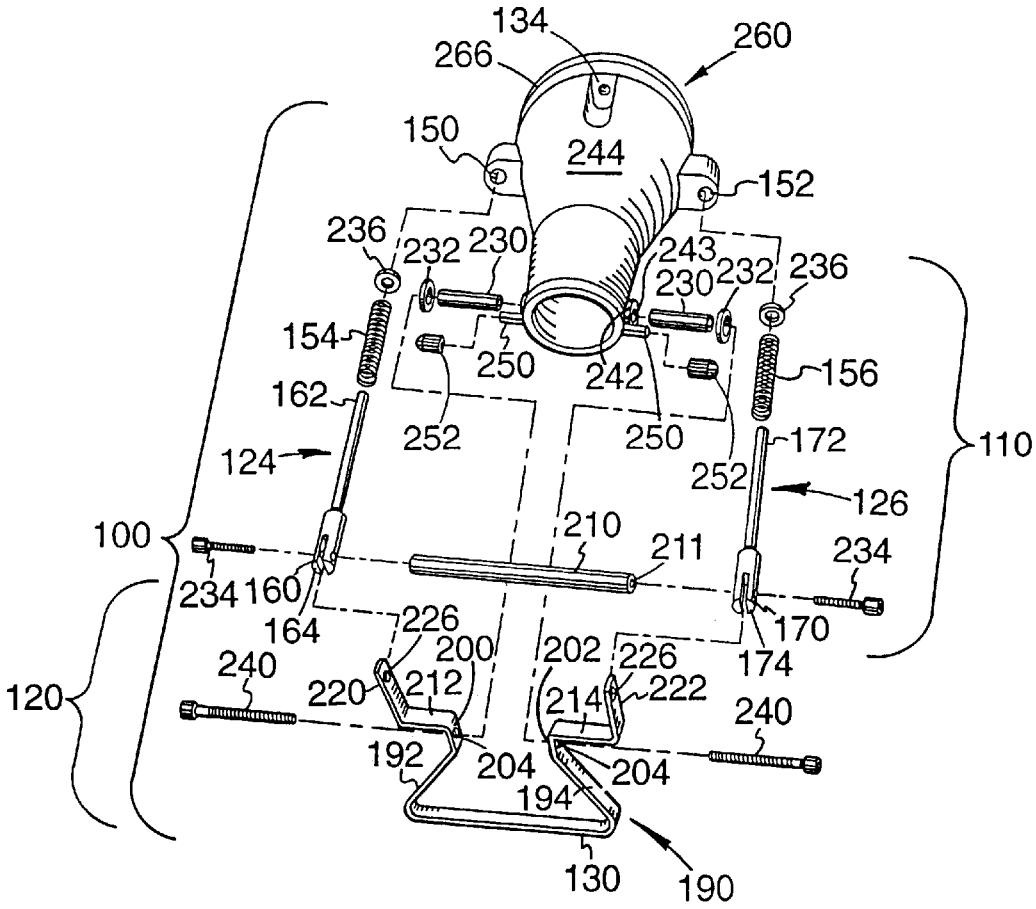
FIG. 8 depicts a rear, exploded, perspective view of safety release cable for a train 100.

Adding FIG. 2 to the discussion, receptacle 112 is mounted on a locomotive or railway car 114 (shown partially). As can be seen, gripping and moving of handle assembly 120 by hand 116 permits movement of both first push rod 124 and second push rod 126 (FIG. 4). Such movement, being substantially symmetrical, with first push rod 124 and second push rod 126 also being substantially symmetrical permits an even push which safely removes the release cable 100 from receptacle 112 as desired.

Receptacle 112 includes a cover 118 with a cover key 132 on the inside thereof. Cover key 132 fits into head notch 134 when safety release cable 100 is inserted into receptacle 112. Head notch 134 cooperates with cover key 132 to lock safety release cable 100 in receptacle 112. Guide key 136 on safety release cable 100 cooperates with receptacle notch 138 in order to position safety release cable 100 in receptacle 112.

Figure 3:
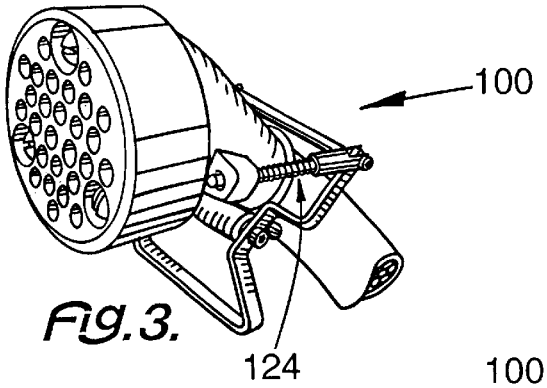
FIG. 3 depicts a front perspective view of the safety release cable for a train 100 of this invention.

With the further consideration of FIG. 3 and FIG. 4, first push rod 124 is slidably mounted in first push rod guide 150, while second push rod 126 is slidably mounted in second push rod guide 152. The first push rod spring 154 surrounds first push rod 124 and second push rod spring 156 surrounds second push rod 126. The first push rod 124 is substantially symmetrical and parallel to the second push rod 126, in a preferred form.

Considering additionally FIG. 5, FIG. 6, FIG. 7 and FIG. 8, the first push rod spring 154 and the second push rod spring 156 contact first push rod guide 150 and second push rod guide 152 respectively at one end thereof. Oppositely disposed from first push rod guide 150 on the first push rod 124, is first pinable member 160.

The first pinable member 160 has a first spring support end 162, which contacts first push rod spring 154 and is oppositely disposed from first push rod guide 150. First pinable member 160 has a first pin receiving end 164 oppositely disposed from first spring support end 162.

The second pinable member 170 has a second spring support end 172, which contacts second push rod spring 156 and is oppositely disposed from second push rod guide 152. Second pinable member 170 and a second pin receiving end 174 is oppositely disposed from second spring support end 172.

First pin receiving end 164 and second pin receiving end 174 each have a rod slot 180 therein. Each rod slot 180 has a first rod wing 182 and a second rod wing 184 forming sides thereof. Within each of first rod wing 182 and second rod wing 184 is a wing aperture 186, and thus providing for four wing apertures 186. Preferably, the four wing apertures 186 are coaxial.

More particularly, handle assembly 120 has a hand grip 130 centrally located on the handle assembly 120. Hand grip 130 is centrally located on the shaped handle bar 190. The shaped handle bar 190 is preferably a single piece of metal having and bends or other shapes to achieve desired results. Shaped handle bar 190 provides for operation of the safety release cable 100 and connects the elements of handle assembly 120.

Clearly from the structure of hand grip 130 and handle assembly 120, is very possible to tap or strike hand grip 130 or other parts of handle assembly 120 with a hammer (not shown). Such tapping can release a frozen handle assembly 120 without any of damaging safety release cable assembly 100, release assembly 110 or receptacle 112.

Hand grip 130 is of sufficient width to permit easy gripping thereof with a hand 116. The first inward bend 192 and a second inward bend 194 are at opposing ends of the handle grip 130 and effectively form the equal, nonparallel sides of what may be an isosceles trapezoid.

The first inward bend 192 and the second inward bend 194 in each extend into first hinge platform 200 and second hinge platform 202 respectively. First hinge platform 200 and second hinge platform 202 are preferably parallel to each other and have an extended perpendicularity relative to handle grip 130. Within first hinge platform 200 and second hinge platform 202 are hinge apertures 204. From hinge apertures 204, the main hinge bolts 240 may pass into the hinge apertures 204, through lever bushings 230 and then into housing tube 242.

From the first hinge platform 200 and the second hinge platform 202, the handle bar 190 provides first parallel platform 212 and second parallel platform 214 respectively being parallel to handle grip 130. By the same token, first parallel platform 212 and second parallel platform 214 extend into first pushing lever 220 and second pushing lever 222.

Both first pushing lever 220 and second pushing lever 222 include a lever aperture 226. Each lever aperture 226 fits into rod slot 180 and aligns with the wing apertures 186. In this fashion, hinge linkage rod 210 may receive rod hinge bolts 240. Firstly, however, each rod hinge bolt 240 passes through a first wing aperture 186, then through a lever aperture 226, followed by a second wing aperture 186 before fitting into a threaded relation with linkage rod 210 hinge bolts 234.

Each pair of wing apertures surrounding rod slot 180 have the same central axis. As each lever aperture 226 aligns with a pair of wing apertures 186, rod hinge bolts 240 pass therethrough and secure the release assembly 120. Cooperating with first pushing lever 220 and second pushing lever 222 is hinge linkage rod 210, as hinge linkage rod 210 is secured between first pushing lever 220 and second pushing lever 222.

If desired a cradle washer 236 may support first push rod spring 154 and second push rod spring 156 on the respective first push rod guide 150 and second push rod guide 152 by being positioned at each point therebetween. In this fashion each of spring 154 and 156 better positioned on first push rod 124 and second push rod 126 respectively.

By the same token, main hinge bolts 240 pass through a tube aperture 243 on a head housing 244 for the safety release cable 100. Preferably, a stop shaft 250 is adapted to contact first parallel platform 202 and second parallel platform 204 if desired, stop shaft 250 may include stop shaft covers 252 on each end thereof Stop shaft 250 prevents first push rod spring 154 and second push rod spring 156 from disassembling the handle assembly 120.

Figure 9:
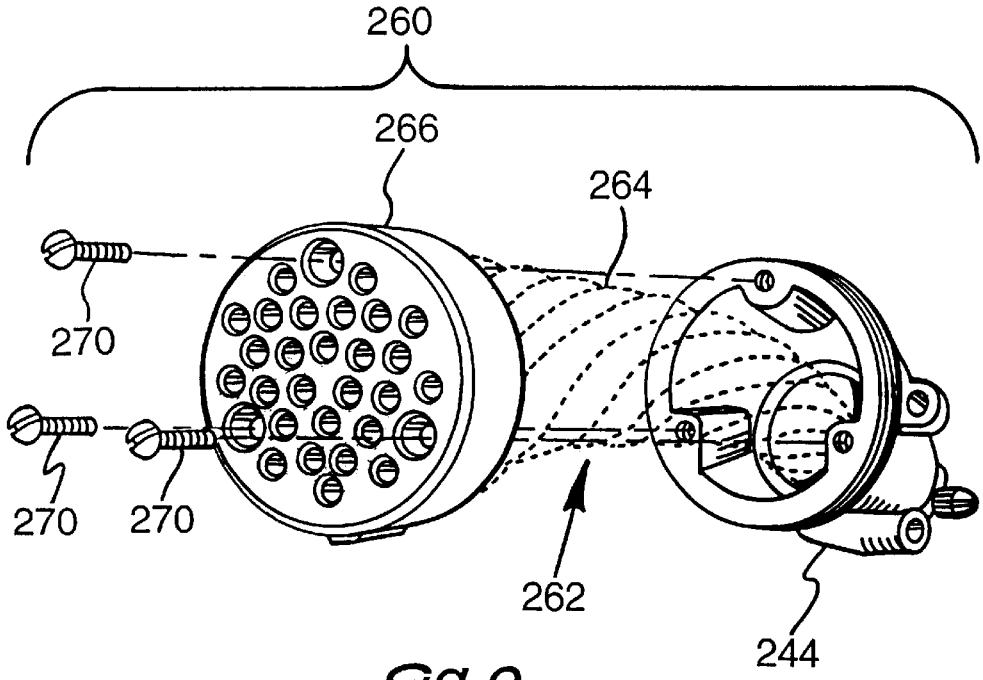
FIG. 9 depicts a front, exploded, perspective view of safety release cable for a train 100.

With FIG. 9 added to the consideration, head assembly 260 on each end of a wire assembly 262 with insulation 264 there around forms safety release cable assembly 100. Head assembly 260 includes a head cap 266 mounted on a head housing 244. Head screws 270 secure head cap 266 to head housing 244 in a threaded relation. Head housing 244 is operably secured to wire assembly 262. The handle assembly 120 is substantially mounted on head housing 244.

Head notch 134 (also shown in FIG. 2) is positioned on head housing 244 in order to cooperate with cover key 132. Guide key 136 on safety release cable 100 cooperates with receptacle notch (not shown) in order to position safety release cable 100 in receptacle 112. Between head notch 134 and receptacle notch 138, safety release cable 100 may be properly positioned.

This application; taken as a whole with the abstract, specification, claims, and drawings being combined; provides sufficient information for a person having ordinary skill in the art to practice the invention as disclosed and claimed herein. Any measures necessary to practice this invention are well within the skill of a person having ordinary skill in this art after that person has made a careful study of this disclosure.

Because of this disclosure and solely because of this disclosure, modification of this method and device can become clear to a person having ordinary skill in this particular art. Such modifications are clearly covered by this disclosure.

What is claimed and sought to be protected by Letters Patent of the United States is:

1. A safety release cable for a train, having a release assembly mounted on the cable, comprising (a) the connecting cable including a conductor with a first head assembly at a first cable end of the conductor and a second head assembly at a second cable end of the conductor;

(b) the first head assembly being oppositely disposed from the second head assembly;

(c) the release assembly being mounted on at least one connector selected from the group consisting of the first head assembly and the second head assembly;

(d) the release assembly having an accessible gripping means;

(e) the release assembly having a handle assembly;

(f) the handle assembly having a gripping member;

(g) the handle assembly operating a first push rod and a second push rod;

(h) the first push rod and the second push rod cooperating to release the connecting cable;

(i) the handle assembly including a hinge assembly mounted on the at least one connector to support the handle assembly;

(j) the gripping member being an U-shaped gripping member;

(k) the handle assembly including a shaped handle bar, a hinge assembly, a push rod mounting, and a pin mounting;

(l) the shaped handle bar cooperating with the hinge, and the pin mounting in order to operate the first push rod and the second push rod; and (m) the first push rod and the second push rod cooperating to separate the safety release cable from the train.

2. The safety release cable for a train of claim 1, further comprising:

(a) the first push rod and the second push rod being mounted on oppositely disposed sides of the at least one connector;

(b) the at least one connector supporting the handle assembly; and (c) the head assembly having a head housing and a head cap.

3. The safety release cable for a train of claim 2, further comprising:

(a) a first push rod mounting and a second push rod mounting being mounted on the head housing;

(b) the first push rod mounting receiving the first push rod;

(c) the second push rod mounting receiving the second push rod;

(d) the first push rod being slidably mounted in the first push rod mounting; and (e) the second push rod being slidably mounted in the second push rod mounting.

4. The safety release cable for a train of claim 3, further comprising:

(a) the first push rod being substantially parallel to the second push rod;

(b) the first push rod being substantially symmetrical to the second push rod;

(c) the first push rod including a first pin mounting at one end thereof;

(d) the second push rod including a second pin mounting at one end thereof;

(e) a first push rod spring being mounted on the first push rod;

(f) a second push rod spring being mounted on the second push rod;

(g) the first push rod spring contacting the first push rod guide and the first pin mounting; and (h) the second push rod spring contacting the second push rod guide and the second pin mounting.

5. The safety release cable for a train of claim 4, further comprising:

(a) the first pin receiving end having a first rod slot therein;

(b) the second pin receiving end having a second rod slot therein;

(c) the first rod slot receiving a first portion of the shaped handle bar;

(d) the second rod slot receiving a second portion of the shaped handle bar; and (e) the shaped handle bar being movably secured in the first rod slot and the second rod slot.

6. The safety release cable for a train of claim 5, further comprising:

(a) the shaped handle bar having a hand grip centrally located thereon;

(b) the shaped handle bar having a first inward bend and a second inward bend at opposing ends thereof;

(c) the first inward bend extending into a first hinge platform;

(d) the second inward bend extending into a second hinge platform;

(e) the first hinge platform extending into a first parallel platform;

(f) the second hinge platform extending into a second parallel platform;

(g) the first parallel platform extending into a first pushing lever; and (h) the second parallel platform extending into a second pushing lever.

7. The safety release cable for a train of claim 6, further comprising:

(a) the first inward bend and the second inward bend forming angled sides of an isosceles trapezoid;

(b) the first hinge platform and the second hinge platform being mutually parallel and perpendicular to the hand grip;

(c) the first parallel platform and the second parallel platform parallel to the hand grip; and (d) the first pushing lever and the second pushing lever being perpendicular to the hand grip.

8. The safety release cable for a train of claim 7, further comprising:

(a) the first push rod being movably pinned to the first pushing lever;

(b) the second push rod being movably pinned to the second pushing lever;

(c) the hinge assembly including a hinge tube;

(d) the hinge tube the being mounted on the head housing;

(e) the hinge assembly including a linkage rod received in the hinge tube;

(f) the linkage rod being received between the first hinge platform and the second hinge platform; and (g) a securing means supporting the linkage rod.

9. The safety release cable for a train of claim 8, further comprising:

(a) a second hinge bolt securing the linkage rod to the first hinge platform;

(b) a second hinge bolt securing the linkage rod to the first hinge platform;

(c) a stop shaft means secured to the head housing between the hinge tube and the cable; and (d) the stop shaft keeping the handle assembly along with the first push rod and the second push rod in a desired position.

10. The safety release cable for a train of claim 9, further comprising:

(a) the stop shaft contacting the adapted to contact first parallel platform and the second parallel platform;

(b) the stop shaft preventing a disassembly of the handle; a and (c) the first push rod and the second push rod permitting an even push in order to safely remove the release cable.

11. A safety release cable for a train, having a release assembly mounted on the cable, comprising (a) the cable including a conductor with a first head assembly at a first cable end of the conductor and a second head assembly at a second cable end of the conductor;

(b) the first head assembly being oppositely disposed from the second head assembly;

(c) the release assembly being mounted on at least one connector selected from the group consisting of the first head assembly and the second head assembly;

(d) the release assembly having an accessible gripping means;

(e) the release assembly having a handle assembly;

(f) the handle assembly having a gripping member;

(g) the handle assembly operating a first push rod and a second push rod;

(h) the first push rod and the second push rod cooperating to release the connecting cable;

(i) the handle assembly including a hinge assembly mounted on the at least one connector to support the handle assembly;

(j) the gripping member being an U-shaped gripping member;

(k) the first push rod and the second push rod being mounted on oppositely disposed sides of the at least one connector;

(l) the handle assembly including a shaped handle bar, a hinge assembly, a push rod mounting, and a pin mounting;

(m) the shaped handle bar cooperating with the hinge, and the pin mounting in order to operate the first push rod and the second push rod; and (n) the first push rod and the second push rod cooperating to separate the safety release cable from the train;

(o) the at least one connector supporting the handle assembly;

(p) the head assembly having a head housing and a head cap;

(q) a first push rod mounting and a second push rod mounting being mounted on the head housing;

(r) the first push rod mounting receiving the first push rod; and (s) the second push rod mounting receiving the second push rod.

12. The safety release cable for a train of claim 11, further comprising:

(a) the first push rod being slidably mounted in the first push rod mounting (b) the second push rod being slidably mounted in the second push rod mounting;

(c) the first push rod being substantially parallel to the second push rod;

(d) the first push rod being substantially symmetrical to the second push rod;

(e) the first push rod including a first pin mounting at one end thereof;

(f) the second push rod including a second pin mounting at one end thereof;

(g) a first push rod spring being mounted on the first push rod;

(h) a second push rod spring being mounted on the second push rod;

(i) the first push rod spring contacting the first push rod guide and the first pin mounting; and (j) the second push rod spring contacting the second push rod guide and the second pin mounting.

13. The safety release cable for a train of claim 12, further comprising;

(a) the first pin receiving end having a first rod slot therein;

(b) the second pin receiving end having a second rod slot therein;

(d) the first rod slot receiving a first portion of the shaped handle bar;

(e) the second rod slot receiving a second portion of the shaped handle bar;

(f) the shaped handle bar being movably secured in the first rod slot and the second rod slot;

(g) the shaped handle bar having a hand grip centrally located thereon;

(h) the shaped handle bar having a first inward bend and a second inward bend at opposing ends thereof;

(i) the first inward bend extending into a first hinge platform;

(j) the second inward bend extending into a second hinge platform;

(k) the first hinge platform extending into a first parallel platform; and (l) the second hinge platform extending into a second parallel platform.

14. The safety release cable for a train of claim 13, further comprising:

(a) the first parallel platform extending into a first pushing lever;

(b) the second parallel platform extending into a second pushing lever;

(c) the first inward bend and the second inward bend forming angled sides of an isosceles trapezoid;

(d) the first hinge platform and the second hinge platform being mutually parallel and perpendicular to the hand grip;

(e) the first parallel platform and the second parallel platform parallel to the hand grip; and (f) the first pushing lever and the second pushing lever being perpendicular to the hand grip.

15. The safety release cable for a train of claim 14, further comprising:

(a) the first push rod being movably pinned to the first pushing lever;

(b) the second push rod being movably pinned to the second pushing lever;

(c) the hinge assembly including a hinge tube;

(d) the hinge tube the being mounted on the head housing;

(e) the hinge assembly including a linkage rod received in the hinge tube;

(f) the linkage rod being received between the first hinge platform and the second hinge platform; and (g) a securing means supporting the linkage rod.

16. The safety release cable for a train of claim 15, further comprising:

(a) a second hinge bolt securing the linkage rod to the first hinge platform;

(b) a second hinge bolt securing the linkage rod to the first hinge platform;

(c) a stop shaft means secured to the head housing between the hinge tube and the cable;

(d) the stop shaft keeping the handle assembly along with the first push rod and the second push rod in a desired position;

(e) the stop shaft being adapted to contact the first parallel platform and the second parallel platform;

(f) the stop shaft preventing a disassembly of the handle; and (g) the first push rod and the second push rod permitting an even push in order to safely remove the release cable.

17. A method of attaching or removing a safety release cable relative to a locomotive or a transit car comprising:

(a) providing the safety release cable in the form of a release assembly mounted on the cable;

(b) providing the cable with a conductor having a first head assembly at a first cable end and a second head assembly at a second cable end;

(c) having the first head assembly be oppositely disposed from the second head assembly;

(d) mounting the release assembly on at least one connector selected from the group consisting of the first head assembly and the second head assembly;

(e) providing an accessible gripping means for the release assembly;

(f) providing a handle assembly for the release assembly;

(g) providing a gripping member for the handle assembly as part of the gripping means;

(h) operating a first spring loaded push rod and a second spring loaded push rod with the handle assembly in order to remove the safety release cable;

(i) providing stop shaft means to secure the handle assembly; and (j) support the cable on the locomotive or the transit car with an oppositely disposed notch and lock system.

* * * * *